US006486904B1

(12) United States Patent
Onozato et al.

(10) Patent No.: US 6,486,904 B1
(45) Date of Patent: Nov. 26, 2002

(54) THERMAL TRANSFER PRINTER THAT IS CAPABLE OF MAINTAINING INTERMEDIATE TRANSFER SHEET TENSION CONSTANT

(75) Inventors: Takashi Onozato, Iwate-ken (JP); Hiroshi Takahashi, Iwate-ken (JP); Tadami Kikuchi, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/144,204

(22) Filed: May 10, 2002

(30) Foreign Application Priority Data

May 14, 2001 (JP) ..... 2001-143450

(51) Int. Cl.[7] ..... B41J 15/16; B41J 2/325; B41J 3/407

(52) U.S. Cl. ..... 347/213; 347/219; 242/412.1; 242/412.2; 226/30; 226/44

(58) Field of Search ..... 347/219, 213, 347/172, 174, 176; 400/120.02, 120.04, 618; 226/195, 44, 30; 242/410, 147, 412, 412.1, 412.2

(56) References Cited

U.S. PATENT DOCUMENTS 3,731,890 A * 5/1973 Ruoff et al. ..... 242/188
5,798,161 A 8/1998 Kita et al.

FOREIGN PATENT DOCUMENTS

EP 0 585 852 A2 3/1994

* cited by examiner

*Primary Examiner*—Huan H. Tran
(74) *Attorney, Agent, or Firm*—Brinks Hofer Gilson & Lione

(57) ABSTRACT

The thermal transfer line printer is provided with tension roller position detection means having tension rollers, rotatable tension roller support frames that support the tension rollers rotatably and press the tension rollers toward an intermediate sheet, and a detector and a sensor for detecting a position of the tension rollers and is provided with a controller for controlling operation of an intermediate transfer sheet feeding motor that moves at least the intermediate transfer sheet, and the controller controls the intermediate transfer sheet feeding motor so as to position the detectors in a detection range of the sensors when the intermediate transfer sheet is moved.

2 Claims, 4 Drawing Sheets

THERMAL TRANSFER PRINTER THAT IS CAPABLE OF MAINTAINING INTERMEDIATE TRANSFER SHEET TENSION CONSTANT

BACKGROUND OF THE INVENTION

1. Field of the Invention

This invention relates to a thermal transfer line printer that is suitably used for forming an intermediate transfer type image in which ink of a multi-color ink sheet is transferred on an intermediate transfer sheet by means of a line thermal head to form a primary image and the primary image is retransferred on a transfer medium to form an image on the transfer medium.

2. Description of the Related Art

Heretofore, the intermediate transfer type thermal transfer line printer for forming an image on a transfer medium by means of a method in which ink of a multi-color ink film is transferred on an intermediate transfer medium by use of a line thermal head to form a primary image and the primary image is retransferred on a transfer medium by use of a retransfer means has been used widely as an output apparatus of a computer or ward processor. The reasons are that a high quality printed image can be formed easily on various transfer media such as CD, CD-R, MO, DVD, and various cards in addition to regular paper and that the intermediate transfer type thermal transfer line printer is operated with low noise, available at low cost, and needs less maintenance.

A conventional thermal transfer line printer as described hereinabove operates as described hereunder. A line thermal head is brought into down-state in which the line thermal head is brought into contact with a platen roller with interposition of an ink sheet and an intermediate transfer sheet that are formed in the configuration of long sheet in this order in a primary image forming section. Heating elements of the line thermal head are heated selectively based on the printing information with feeding the ink sheet and the intermediate transfer sheet in this state to thereby melt or sublimate the ink carried on the ink sheet so that the ink is transferred on the intermediate transfer sheet, and a reverse image that is served as the intermediate image for one page, namely one picture, is formed on the intermediate transfer sheet. Thereafter, the intermediate transfer sheet is moved and the primary image formed on the intermediate transfer sheet is concomitantly moved to the position just before the retransfer section, and then the primary image is registered with a transfer medium with aid of the register mark formed on the intermediate transfer sheet. Then, the primary image formed on the intermediate transfer sheet is melted or sublimated by applying heat and pressure of retransfer means comprising a heating roller in a retransfer section, and the primary image is retransferred and fixed on the transfer medium to thereby form a desired image on the transfer medium.

At that time, in the case where a monochrome image of one color is formed on a transfer medium, one pass is enough for forming an image.

On the other hand, in the case where a multi-color image is formed on a transfer medium, a multi-color intermediate image is formed by means of so-called swing-back technique as described hereunder. A multi-color ink sheet on which a plurality of color ink regions are arranged so that different colors are repeated adjacently in the longitudinal direction issued as an ink sheet. At first, a reverse image of the first color ink that is carried on the multi-color ink sheet is formed on an intermediate transfer sheet. Then, a line thermal head is brought into head-up state in which the line thermal head is being separated from a platen, and the intermediate transfer sheet is moved reversely to the transfer preparation position in this state. The reverse image formed with the first color ink is returned to the transfer position for start alignment, and a reverse image of the next color is transferred on the reverse image of the first color one on the other.

In detail, in the case where a full-color image is formed, a multi-color ink sheet on which a plurality of ink regions, each of which consists of four colors, for example, K (black), Y (yellow), M (magenta), and C (cyan) are arranged so that the different colors are repeated adjacently in the longitudinal direction and which has color-discrimination marks on the boundary between different ink regions is used as an ink sheet.

More in detail, at first, a K-color reverse image for one page picture is formed on an intermediate transfer sheet by use of a K-color ink region on the multi-color ink sheet. Next, the intermediate transfer sheet that has been moved during the primary image forming operation is moved in the reverse direction to the transfer preparation position to align the K-color reverse image formed on the intermediate transfer sheet, and a Y-color ink region that is positioned adjacent to the K-color ink region of the multi-color ink sheet is aligned. With the use of the Y-color ink region in the multi-color sheet, a Y-color reverse image for one page picture is formed over the K-color reverse image for one page picture that has been formed on the intermediate transfer sheet. Similarly, reverse images of an M-color ink region and a C-color ink region are formed on the intermediate transfer sheet in this order to thereby form a full-color intermediate image for one page picture on the intermediate transfer sheet.

The conventional register mark that has been formed on an intermediate transfer sheet previously or is formed simultaneously when a primary image is formed on an intermediate transfer sheet.

Furthermore, the intermediate transfer sheet is wound between the intermediate transfer sheet feeding roller and the intermediate transfer sheet winding roller. The intermediate transfer sheet winding roller is rotated by means of the driving force of the intermediate transfer sheet feeding motor when a reverse image is formed, and the intermediate transfer sheet is sent out from the intermediate transfer sheet feeding roller and wound on the intermediate transfer sheet winding roller. Furthermore, in the case where the intermediate transfer sheet is moved back to the printing preparation position to form a full-color image, the intermediate transfer sheet feeding roller is rotated reversely by means of the driving force of the intermediate transfer sheet feeding motor. Thereby, the intermediate transfer sheet is moved in the reverse direction toward the intermediate transfer sheet feeding roller side from the intermediate transfer sheet winding roller side.

As the result of the above operation, the length of the intermediate transfer sheet wound on the intermediate transfer sheet feeding roller decreases with consumption of the intermediate transfer sheet to result in the reduced outside diameter of the intermediate transfer sheet feeding roller, and on the other hand the length of the intermediate transfer sheet wound on the intermediate transfer sheet winding roller increases to result in the increased outside diameter of the intermediate transfer sheet winding roller.

However, in the case of the abovementioned conventional thermal transfer line printer, the intermediate transfer sheet tension changes due to the change of the outside diameter of the intermediate transfer sheet feeding roller and the intermediate transfer sheet winding roller that is caused concomitantly with consumption of the intermediate transfer sheet, and the change causes the problem.

The change of the intermediate transfer sheet tension causes the change of moving length of the intermediate transfer sheet when the intermediate transfer sheet is moved reversely to the printing preparation position for forming a full-color image, and the change of the moving length causes positional deviation when the reverse image is transferred on the intermediate transfer sheet to result in the poor picture quality of the image printed on a transfer medium.

To solve the abovementioned problem, a thermal transfer line printer that is capable of maintaining the intermediate transfer sheet tension constant has been expected to be developed.

SUMMARY OF THE INVENTION

The present invention has been accomplished in view of the abovementioned problem, and it is the object of the present invention to provide a thermal transfer line printer that is capable of maintaining the intermediate transfer sheet tension constant with the simple structure.

To achieve the abovementioned object, a thermal transfer line printer in accordance with the present invention is characterized in that the thermal transfer line printer has a tension roller disposed so as to face to a moving path of the intermediate transfer sheet, a rotatable tension roller support frame that supports the tension roller rotatably and presses the tension roller against the intermediate transfer sheet, tension roller position detection means that detects a position of the tension roller, and a controller that controls operation of an intermediate transfer sheet feeding motor for feeding at least the intermediate transfer sheet, the tension roller position detection means is provided with a detector disposed on the tension roller support frame and a sensor that detects the position of the detector, and the controller, when feeding the intermediate transfer sheet, controls the intermediate transfer sheet feeding motor so as to maintain the detector in a detection range of the sensor.

At that time, the tension roller is provided preferably on any one of both sides of the primary image forming section, and more preferably the tension roller is provided on both sides of the primary image forming section.

By employing the abovementioned structure, the intermediate transfer sheet tension can be maintained constant with the simple structure.

DETAILED DESCRIPTION OF THE PREFERRED EMBODIMENTS

The present invention will be described according to the embodiment in detail hereinafter with reference to the drawings.

Figure 1:
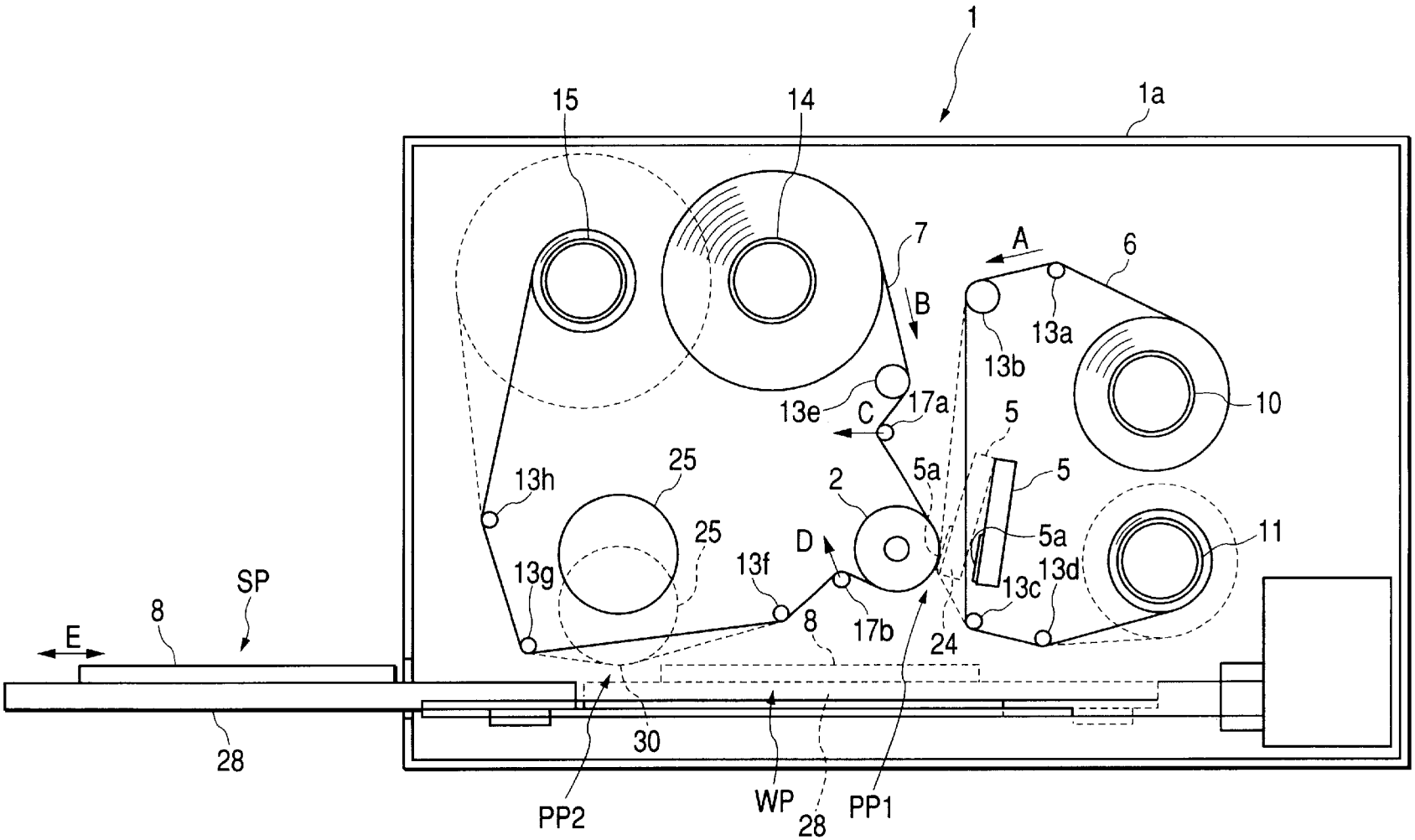
FIG. 1 is a partial front view showing the whole structure of an embodiment of a thermal transfer line printer in accordance with the present invention.
Figure 2:
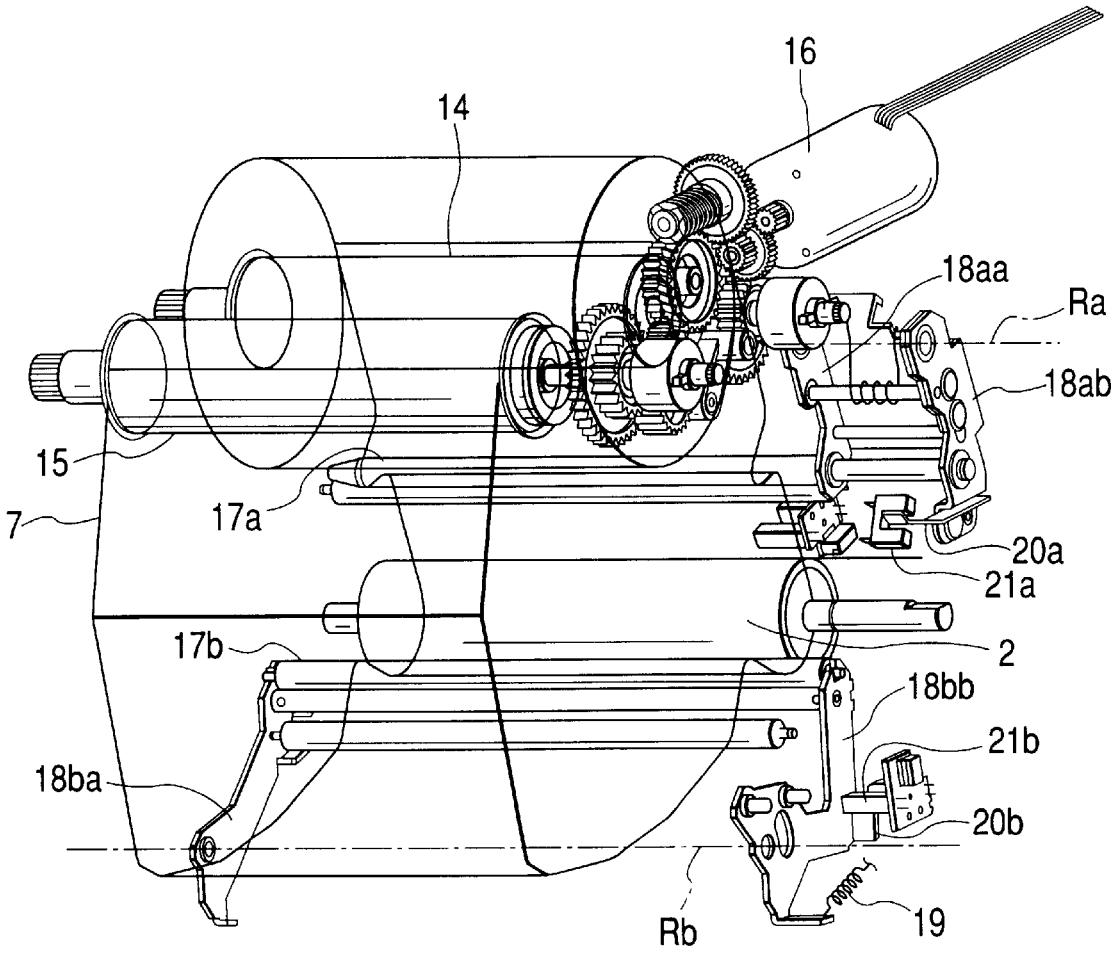
FIG. 2 is a partial perspective view of FIG. 1.
Figure 3:
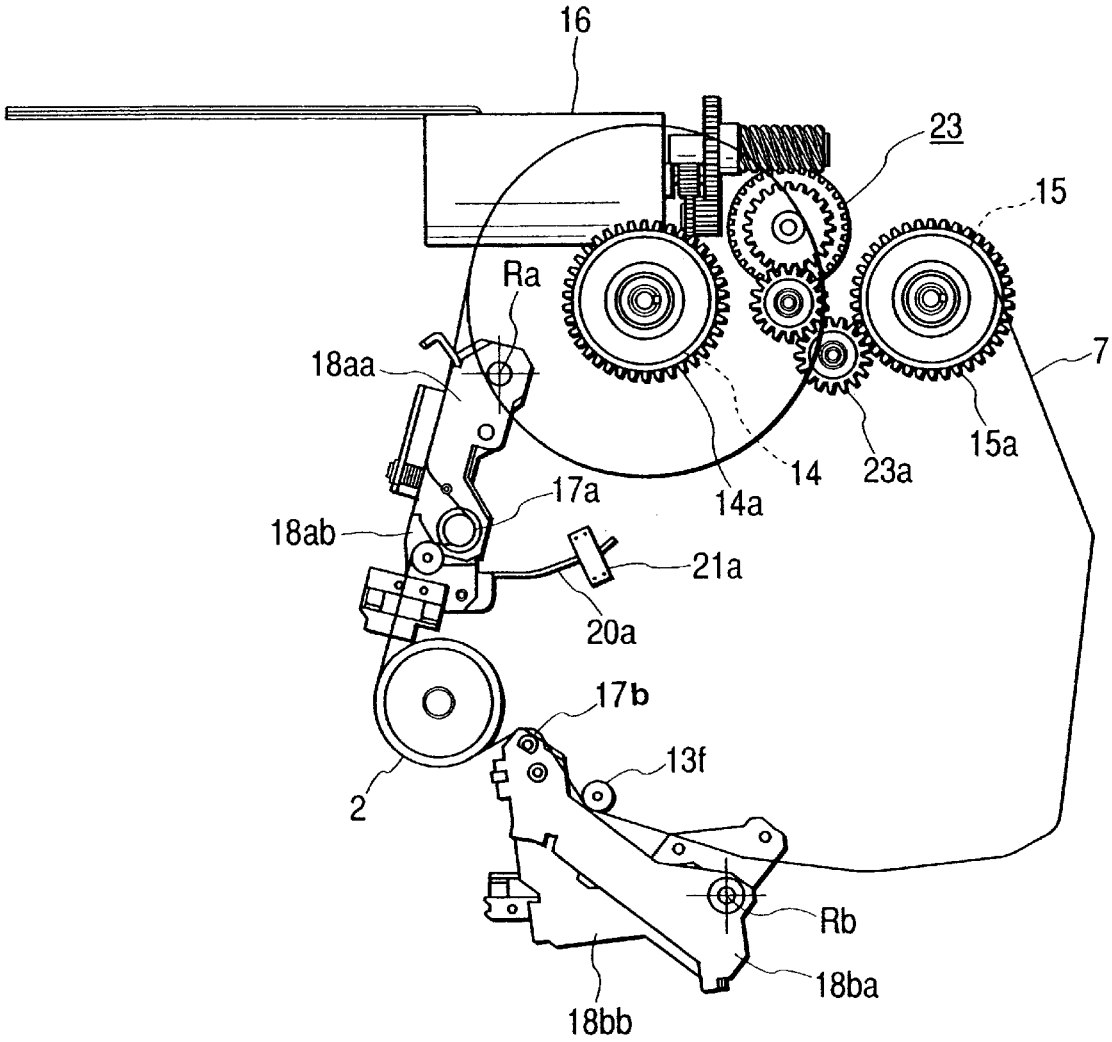
FIG. 3 is a back view of FIG. 2.
Figure 4:
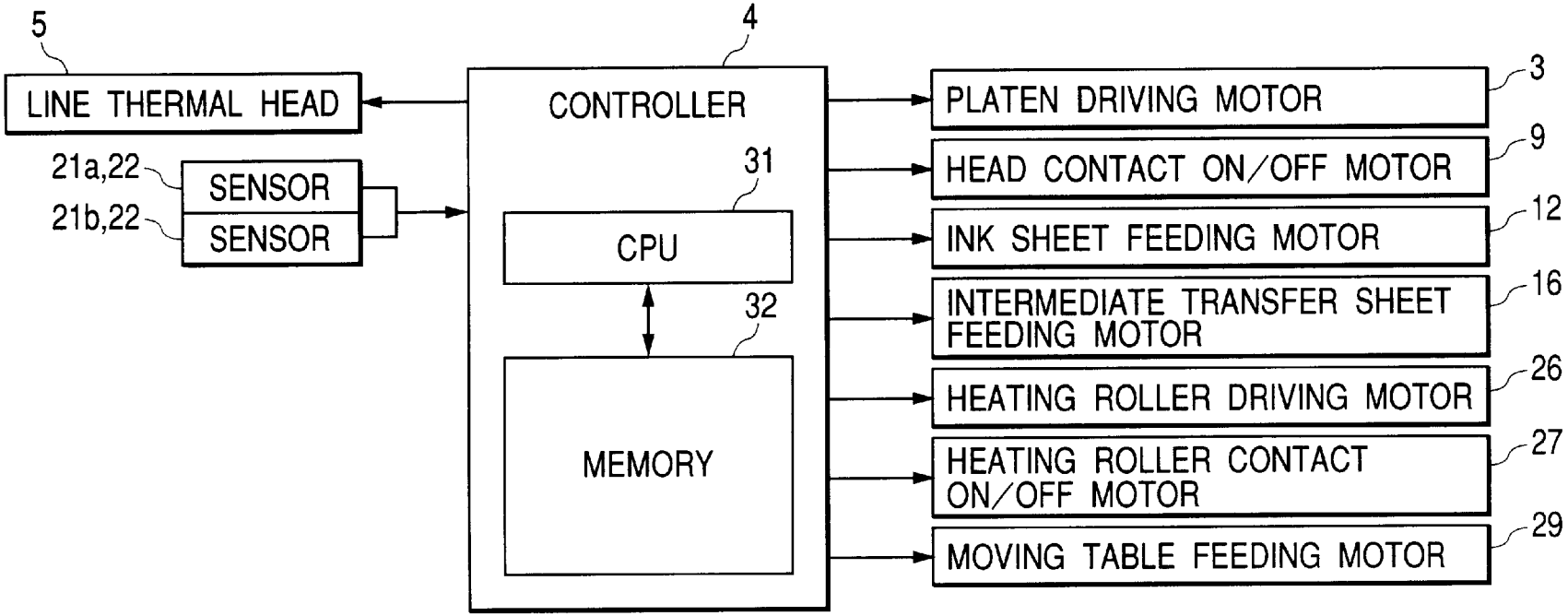
FIG. 4 is a block diagram showing the partial structure of a controller.

FIG. 1 to FIG. 4 show an embodiment of a thermal transfer line printer in accordance with the present invention. FIG. 1 is a partial front view showing the whole structure of an embodiment of a thermal transfer line printer in accordance with the present invention, FIG. 2 is a partial perspective view of FIG. 1, FIG. 3 is a back view of FIG. 2, and FIG. 4 is a block diagram showing the partial structure of a controller.

An exemplary thermal transfer line printer of the present embodiment is served to form a full-color image by use of a multi-color ink sheet on which four-color ink regions formed of four color inks, namely K, Y, M, and C, are arranged repeatedly in this order so that the different colors are located adjacently in the longitudinal direction and on which the color-discrimination mark is formed on the boundary between respective ink regions.

As shown in FIG. 1, a platen roller 2 is provided rotatably in a printer body 1*a* of the thermal transfer line printer of the present embodiment. The platen roller 2 is rotatably formed by receiving transmission of driving force of a platen driving motor 3 (FIG. 4) such as a stepping motor. The platen driving motor 3 is connected electrically to a controller 4 (FIG. 4) that is served to control the operation of other sections described hereinafter, and the stopping, starting, rotation speed, and rotation direction are controlled based on the control command sent out from the controller 4.

A line thermal head 5 that can be brought into contact with and detached from the platen roller 2 is provided on the right side of the platen roller 2 shown on the left in FIG. 1 so that a printing surface 5*a* faces to the outer peripheral surface of the platen roller 2. The line thermal head 5 extends in the direction parallel to the axial direction of the platen roller 2. Furthermore, on the printing surface 5*a* of the line thermal head 5, a plurality of heating elements (not shown in the drawings) are arranged over the length equivalent to the size of the multi-color ink sheet 6 and the size of the intermediate transfer sheet 7 in the direction orthogonal to the moving direction of the multiple-color ink sheet 6 shown by the arrow A shown in FIG. 1 and in the direction orthogonal to the moving direction of the intermediate transfer sheet 7 shown by the arrow B shown in FIG. 1. The length of a heating element is formed so as to be longer than the size in the direction that is orthogonal to the moving direction of an image formed on the transfer medium 8. Furthermore, the line thermal head 5 is connected electrically to the controller 4 (FIG. 4) that will be described hereinafter, and each heating element is heated selectively based on the control command sent out from the controller 4 according to the printing information.

The line thermal head 5 is fabricated so as to be positioned at least at two positions selectively by means of a head contact ON/OFF mechanism, not shown in the drawings, that is operated by means of driving force of the head contact ON/OFF motor 9 (FIG. 4). One position is the head-up position in which the head is positioned at the up-position, that is, the head is separated from the platen roller 2 as shown with a solid line in FIG. 1, and the other position is the head-down position in which the head is positioned at the down-position, that is, the head is in contact with the platen roller 2 with pressure as shown with a broken line in FIG. 1. The head contact ON/OFF motor 9 is connected electrically to the controller 4 (FIG. 4) that is served to control the operation of other sections that will be described hereinafter, and the position of the line thermal head 5 is controlled based on the control command sent out from the controller 4 at the desired timing.

The multi-color ink sheet 6 and the intermediate transfer sheet 7 are supplied in the order from the line thermal head 5 side between the platen roller 2 and the line thermal head 5.

The multi-color ink sheet 6 is wound between the ink sheet feeding roller 10 disposed in the printer body 1*a* near the left portion of FIG. 1 and an ink sheet winding roller 11 disposed under the ink sheet feeding roller 10. The multi-color ink sheet 6 is sent out from the ink sheet feeding roller 10 by at least rotating the ink sheet winding roller 11 by means of driving force of an ink sheet feeding motor 12 (FIG. 4) comprising a control motor such as stepping motor, and is wound on the ink sheet winding roller 11. Furthermore, the moving path and moving direction of the multi-color ink sheet 6 to be sent out by the ink sheet feeding roller 10 are controlled so as to be wound on the ink sheet winding roller 11 through four guide rollers disposed rotatably in the printer body 1*a* in the order from 13*a*, to 13*b*, 13*c*, and 13*d* as shown with an arrow A in FIG. 1. Furthermore, the moving path of the multi-color ink sheet 6 is formed so that the back surface side on which the ink region (not shown in the drawing) is not formed faces to the line thermal head 5. Furthermore, the ink sheet feeding motor 12 is connected electrically to the controller 4 (FIG. 4) for controlling the operation of other sections that will be described hereinabove, and the stop, start, and rotation speed of the ink sheet feeding motor 12 is controlled based on the control command supplied from the controller 4.

On the other hand, the intermediate transfer sheet 7 is wound between an intermediate transfer sheet feeding roller 14 disposed at the place located above and slightly right from the platen roller 2 in the printer body 1*a* and an intermediate transfer sheet winding roller 15 disposed near the upper right corner in FIG. 1 in the printer body 1*a*. Furthermore, at least the intermediate transfer sheet 7 is sent out from the intermediate transfer sheet feeding roller 14 by rotating the intermediate transfer sheet winding roller 15 by means of driving force of an intermediate transfer sheet feeding motor 16 (FIG. 4), and wound on the intermediate transfer sheet winding roller 15.

Furthermore, the intermediate transfer sheet 7 sent out from the intermediate transfer sheet feeding roller 14 is controlled so as to be moved as described hereunder. As shown with an arrow B in FIG. 1, the intermediate transfer sheet 7 is moved through a guide roller 13*e* and a tension roller 17*a* rotatably disposed in the printer body 1*a* in this order, moved along the outside surface of the platen roller 2, then moved through a tension roller 17*b* that is disposed rotatably in the printer body 1*a* and three guide rollers 13*f*, 13*g*, and 13*h* in this order, and then wound on the intermediate transfer sheet winding roller 15.

The two tension rollers 17*a* and 17*b* disposed on both sides of the platen roller 2, which are located so as to face to the moving path of the intermediate transfer sheet 7, are served to maintain the tension of the intermediate transfer sheet 7 constant. As shown in FIG. 2, the tension roller 17*a* disposed above the overhung platen roller 2 is supported rotatably by a pair of tension roller support frames 18*aa* and 18*ab*. Furthermore, the tension roller 17*b* disposed on the left side of the platen roller 2 is supported at both ends rotatably by a pair of tension roller support frames 18*ba* and 18*bb*. The respective tension roller support frames 18*aa*, 18*ab*, 18*ba*, and 18*bb* are supported rotatably on a mounting frame (not shown in the drawings), and the tension roller support frames 18*aa* and 18*ab* are rotatable round the rotation center Ra shown on the upper portion of FIG. 2 with a dashed line. Furthermore, the tension roller support frames 18*ba* and 18*bb* shown on the lower portion of FIG. 2 are rotatable round the rotation center Rb shown on the lower portion of FIG. 2 with a dashed line. Furthermore, the tension roller support frame 18*a* shown on the upper portion of FIG. 2 and the tension roller support frame 18*bb* shown on the lower portion of FIG. 2 are linked together with a link plate (not shown in the drawings), and the respective tension roller support frames 18*aa*, 18*ab*, 18*ba*, and 18*bb* are formed so as to operate sequentially. Furthermore, the one end of a compression coil spring 19 is fixed to the tension roller support frame 18*bb* shown on the lower portion of FIG. 2, and the other end of the compression coil spring is fixed to a mounting frame (not shown in the drawings) Thereby, the tension support frames 18*ba* and 18*bb* shown on the lower portion of FIG. 2 are pressed in the anti clockwise direction round the rotation center Rb, and on the other hand the tension roller support-frames 18*aa* and 18*ab* shown on the upper portion of FIG. 2 are pressed in the clockwise direction round the rotation center Ra. In other words, the tension roller support frames 18*aa*, 18*ab*, 18*ba*, and 18*bb* are structured so as to press the tension rollers 17*a* and 17*b* toward the intermediate transfer sheet 7.

The tension roller 17*a* is in contact with the intermediate transfer sheet 7 so as to press the intermediate transfer sheet 7 from the right side to the left side in FIG. 1 as shown with an arrow C in FIG. 1. On the other hand, the tension roller 17*b* disposed on the left side of the platen roller 2 is in contact with the intermediate transfer sheet 7 so as to press the intermediate transfer sheet 7 from the under position toward upper left direction in FIG. 1 as shown with an arrow D in FIG. 1.

In the case of the structure that the intermediate transfer sheet 7 is not moved reversely, only the tension roller 17*b* disposed on the winding side, namely left side of the platen roller 2, may be provided.

As shown in FIG. 2, the approximately flat-shaped base ends of the detectors 20*a* and 20*b* are fixed respectively to the two tension roller support frames 18*ab* and 18*bb* shown on the upper right portion of FIG. 2 and on the lower right portion of FIG. 2 respectively. Sensors 21*a* and 21*b* comprising optical sensors (photo interrupter) fixed to a mounting frame (not shown in the drawings) are disposed on the end portions of these detectors 20*a* and 20*b*, and the detectors 20*a* and 20*b* shut off or open the sensors 21*a* and 21*b* to thereby detect the position of the detector 20*a* and 20*b*. These sensors 21*a* and 21*b* are connected electrically to the controller 4 (FIG. 4) for controlling the operation of other sections that will be described hereinafter, and the detection signal that indicates shutting off or opening of the sensors 21*a* and 21*b* by the detectors 20*a* and 20*b* is supplied to the controller 4.

The abovementioned sensor 21*a* and 21*b* and the detectors 20*a* and 20*b* constitute tension roller position detection means 22 for detecting the position of the tension rollers 17*a* and 17*b* of the present embodiment. The detection of the tension rollers 17*a* and 17*b* position will be described hereinafter.

The description will return to FIG. 1. The moving path is formed so that the intermediate transfer sheet 7 is brought into contact with the multi-color ink sheet 6 at the contact position with the platen roller 2, and the intermediate transfer sheet 7 faces to the ink region of the multi-color ink sheet 6 at the contact position.

As shown in FIG. 3, the intermediate transfer sheet feeding roller 14 and the intermediate transfer sheet winding roller 15 are formed rotatably so as to be rotated by means of driving force of intermediate transfer sheet moving motor 16 comprising a servo motor or pulse motor that is rotatable reversely. In detail, the driving force of the intermediate transfer sheet feeding motor 16 is formed so as to be transmitted selectively to any one of an intermediate transfer sheet feeding roller driving gear 14*a* and an intermediate transfer sheet winding roller driving gear 15*a* through a rockable gear 23*a* disposed on the output end of a gear train 23. The driving force of the intermediate transfer sheet feeding motor 16 drives the intermediate transfer sheet winding roller driving gear 15*a* so as to be rotated to thereby send out the intermediate transfer sheet 7 from the intermediate transfer sheet feeding roller 14, and the intermediate transfer sheet 7 is wound on the intermediate transfer sheet winding roller 15. On the other hand, when the intermediate transfer sheet feeding roller driving gear 14*a* is rotated reversely by means of the driving force of the intermediate transfer sheet feeding motor 16, the intermediate transfer sheet 7 is moved reversely from the intermediate transfer sheet winding roller 15 side to the intermediate transfer sheet feeding roller 14 side. Otherwise, the intermediate transfer sheet feeding roller driving gear 14*a* and the intermediate transfer sheet winding roller driving gear 15*a* may be driven by separate intermediate transfer sheet feeding motors 16 independently.

The intermediate transfer sheet 7 used in the present embodiment comprises a long transparent resin film or resin sheet consisting of polyethyleneterephthalate (PET) material or such film or sheet on which some material is coated for easy subsequent retransfer of an intermediate image. Furthermore, the size of the intermediate transfer sheet 7 in the width direction orthogonal to the moving direction shown with an arrow B in FIG. 1 is approximately equal to the size of the multi-color ink sheet 6 in the width direction. Various materials such as thin papers and resin films may be used as the intermediate transfer sheet 7 as long as ink can be transferred from the multi-color ink sheet 6 and the ink that has been transferred on the intermediate transfer sheet 7 can be retransferred on a transfer medium 8.

The abovementioned platen roller 2 and the line thermal head 5 constitute a primary image forming section 24 that is served for transferring the ink of the multi-color ink sheet 6 of the present embodiment on the intermediate transfer sheet 7 to form an intermediate image (not shown in the drawing) comprising a reverse image on the intermediate transfer sheet 7.

Furthermore, in the head-down state shown with a broken line shown in FIG. 1 in which the line thermal head 5 is in contact with the platen roller 2 with a certain contact force, the contact position between the thermal head 5 and the platen roller 2 is the intermediate transfer position PP1 where the ink of the multi-color ink sheet 6 is transferred on the intermediate transfer sheet 7 to thereby form a primary image comprising a reverse image on the intermediate transfer sheet 7.

On the downstream side in the moving direction of the intermediate transfer sheet 7 from the primary image forming section 18, more in detail between two guide rollers 13*f* and 13*g* disposed on the left side from the position of the platen roller 2 in FIG. 1, a heating roller 25 that is served as the retransfer means is disposed so as to face to the moving path of the intermediate transfer sheet 7 from the above. The heating roller 25 is rotated by means of transmission of the driving force of a heating roller driving motor 26 (FIG. 4) such as a stepping motor. Furthermore, the heating roller 25 is structured so as to be positioned selectively at least two positions, namely a separate position in which the heating roller 25 is apart from the intermediate transfer sheet 7 as shown with a solid line in FIG. 1 and a contact position in which the heating roller 25 is in contact with the intermediate transfer sheet 7 with pressure as shown with a broken line in FIG. 1, by means of a heating roller contact ON/OFF mechanism (not shown in the drawings) that is driven by the driving force of the heating roller contact ON/OFF motor 27 (FIG. 4). The heating roller driving motor 26 and the heating roller contact ON/OFF motor 27 are connected electrically to the controller 4 (FIG. 4) served to control the operation of other sections that will be described hereinafter, and the rotation of the heating roller 25 and the position of the heating roller 25 are controlled at the desired timing based on the control command sent out from the controller 4.

A compact disk (CD) used as the transfer medium 8 in the present embodiment, is supplied under the heating roller 25 with interposition of the intermediate transfer sheet 7. The transfer medium 8 is placed on the flat surface of the moving table 28, and the moving table 28 is moved in the right and left direction reciprocally as shown with an arrow E in FIG. 1 by means of the driving force of a moving table moving motor 29 (FIG. 4). The moving table 28 is moved reciprocally by means of the driving force of the moving table moving motor 29 so that the transfer medium 8 can be reciprocated between at least two positions, namely the supply/taking out position SP shown with a solid line in FIG. 1 and the retransfer preparation position WP shown with a broken line in FIG. 1. The moving table moving motor 29 is connected electrically to the controller 4 (FIG. 4) that is served to control the operation of other sections that will be described hereinafter, the operation such as stop, start, rotation speed, and rotation direction is controlled based on the control command sent out from the controller 4. The transfer medium 8 is drawn out from the printer body 1*a* in the supply/taking out position SP as shown with a solid line in FIG. 1, and the transfer medium 8 can be supplied on the moving table 28 and can be taken out from the moving table 28 easily.

The abovementioned transfer medium is by no means limited to CD, and, for example, CD-R, MO, DVD, share certificate, bond certificate, securities, passbooks, railway ticket, theater ticket, entrance ticket, ticket, cash card, credit card, prepaid-card, post card, business card, IC card, optical disk, calendar, poster, pamphlet, ornament, and stationery may be used. Furthermore, any material may be used as the material of the transfer medium 8 such as paper, resin, glass, metal, ceramic, and cloth as long as the heat for retransferring does not cause deformation of the material.

A retransfer section 30 that is served to retransfer the intermediate image formed on the intermediate transfer sheet 7 of the present embodiment to thereby form an image on the transfer medium 8 comprises the heating roller 25.

The pressure contact position shown with a broken line in FIG. 1 where the heating roller 25 presses the transfer medium 8 with a certain contact pressure is the retransfer position PP2 where the intermediate image formed on the intermediate transfer sheet 7 is retransferred on the transfer medium 8 to thereby form an image on the transfer medium 8.

As shown in FIG. 4, the thermal transfer line printer 1 of the present embodiment has the controller 4 that is served to control the operation of other sections, and the controller 4 comprises at least a CPU 31 and a memory 32 such as ROM or RAM having a proper capacity. The controller 4 is connected electrically to at least the platen driving motor 3, line thermal head 5, head contact ON/OFF motor 9, ink sheet feeding motor 12, intermediate transfer sheet moving motor 16, heating roller driving motor 26, heating roller contact ON/OFF motor 27, moving table moving motor 29, sensors 21*a* and 21*b*, alarm means such as indicating lamp or buzzer for notifying an error to an operator (not shown in the drawings), and known various switches such as power source switch and switches that relate to the printing operation.

The abovementioned platen driving motor 3, line thermal head 5, head contact ON/OFF motor 9, ink sheet feeding motor 12, intermediate transfer sheet feeding motor 16, heating roller driving motor 26, heating roller contact ON/OFF motor 27, and moving table moving motor 29 are connected with interposition of an exclusive driving circuit (not shown in the drawings) that is so-called as a controller for driving the respective motors.

The memory 32 of the present embodiment stores a program for controlling the intermediate transfer sheet feeding motor 16 so that the detectors 20*a* and 20*b* are positioned in the detection range of the sensors 21*a* and 21*b* at least when the intermediate transfer sheet is moved, more in detail, a program for controlling the voltage for driving the intermediate transfer sheet feeding motor 16. Furthermore, the memory 32 stores programs for controlling the operation and the operation sequences of various sections and various programs such as a program for initialization that is to be carried out when a power source is switched on, and data such as data required when the intermediate transfer and retransfer are carried out.

Next, the operation of the present embodiment having the abovementioned structure will be described hereunder.

Because the image forming operation on the transfer medium 8 carried out by means of the thermal transfer line printer 1 of the present embodiment is the same as that carried out by means of the conventional thermal transfer line printer, the detailed description is omitted, and only the description that relates to the essential operation of the present invention is presented herein.

According to the thermal transfer line printer of the present invention, the intermediate transfer sheet feeding motor 16 is controlled so as to position the detectors 20*a* and 20*b* in the detection range of the sensors 21*a* and 21*b* when the intermediate transfer sheet 7 is moved.

In detail, if the detectors 20*a* and 20*b* are positioned in the detection range of the sensors 21*a* and 21*b* when the intermediate transfer sheet 7 is moved, the detectors 20*a* and 20*b* send out the detection signal for indicating that the detectors 20*a* and 20*b* shut off the sensor 21*a* and 21*b*, for example, an OFF signal to the controller 4. Furthermore, if the detectors 20*a* and 20*b* move beyond the detection range of the sensors 21*a* and 21*b*, the detectors 20*a* and 20*b* send out the signal for indicating that the detectors 20*a* and 20*b* open the sensors 21*a* and 21*b*, for example, an ON signal to the controller 4.

Then, the controller 4 controls the intermediate transfer sheet feeding motor 16 so that the detectors 20*a* and 20*b* are maintained at the position in the detection range of the sensors 21*a* and 21*b*, and more in detail the controller 4 controls the voltage for driving the intermediate transfer sheet feeding motor 16 in the present embodiment.

By maintaining the detectors 20*a* and 20*b* at the position in the detection range of the sensors 21*a* and 21*b*, the rotation angle of the tension roller support frames 18*aa* and 18*ab* that rotate round the rotation center Ra and the rotation angle of the tension roller support frames 18*ba* and 18*bb* that rotate round the rotation center Rb are both maintained at a certain angle. As the result, the rotation angle round the rotation center Ra of the tension roller 17*a* that is supported rotatably by the tension roller support frames 18*aa* and 18*ab* and the rotation angle round the rotation center Rb of the tension roller 17*b* that is supported rotatably by the tension roller support frames 18*ba* and 18*bb* are fixed at a desired angle. At that time, because the rotation angle of the tension rollers 17*a* and 17*b* that rotate round the rotation centers Ra and Rb respectively is in a certain relation to the tension of the intermediate transfer sheet 7, the tension of the intermediate transfer sheet 7 can be maintained constant by maintaining the rotation angle of the tension rollers 17*a* and 17*b* that rotate round the rotation centers Ra and Rb respectively at a certain angle, in other words, by maintaining the detectors 20*a* and 20*b* at a certain position in the detection range of the sensors 21*a* and 21*b* that have been set.

In other way, pinch rollers may be used instead of the tension rollers 17*a* and 17*b* to maintain the tension of the intermediate transfer sheet 7, but a complex structure is required in this case.

Therefore, according to the thermal transfer printer 1 of the present embodiment, the tension of the intermediate transfer sheet 7 can be maintained constant with a simple structure.

Furthermore, according to the thermal transfer line printer 1 of the present embodiment, because the tension rollers 17*a* and 17*b* are disposed on both sides of the primary image forming section 24, the tension of the intermediate transfer sheet 7 can be maintained constant regardless of the moving direction of the intermediate transfer sheet 7.

The present invention is by no means limited to the abovementioned embodiment, and various modifications may be employed as required.

As described hereinabove, according to the thermal transfer line printer in accordance with the present invention, the tension of an intermediate transfer sheet can be maintained constant with a simple structure, and the present invention exhibits the excellent effect.

What is claimed is:

1. An intermediate transfer type thermal transfer line printer in which ink of a multi-color ink sheet is transferred on an intermediate sheet using a line thermal head to form a primary image, and the primary image is retransferred on a transfer medium using a retransfer mechanism to thereby form a full-color image on the transfer medium, wherein the thermal transfer line printer is provided with a tension roller disposed to face to a moving path of the intermediate transfer sheet, a rotatable tension roller support frame that supports the tension roller rotatably and presses the tension roller against the intermediate transfer sheet, a tension roller position detection mechanism that detects a position of the tension roller, and a controller that controls operation of an intermediate transfer sheet feeding motor that feeds at least the intermediate transfer sheet, wherein the tension roller position detection mechanism is provided with a detector disposed on the tension roller support frame and a sensor that detects the position of the detector, and wherein the controller, when feeding the intermediate transfer sheet, controls the intermediate transfer sheet feeding motor so as to maintain the detector in a detection range of the sensor.

2. The thermal transfer line printer according to claim 1, wherein the tension roller is disposed at least on one side of both sides of a primary image forming section.

* * * * *